US005373787A

United States Patent [19]

Junghans et al.

[11] Patent Number: 5,373,787

[45] Date of Patent: Dec. 20, 1994

[54] DEVICE FOR SAFEGUARDING HAZARDOUS LOCATIONS OF A PRINTING UNIT

[75] Inventors: Rudi Junghans, Wilhelmsfeld; Matthias Zuber, Sinsheim, both of Germany

[73] Assignee: Heidelberger Druckmaschinen AG, Heidelberg, Germany

[21] Appl. No.: 82,592

[22] Filed: Jun. 25, 1993

[30] Foreign Application Priority Data

Jun. 27, 1992 [DE] Germany ..... 4221132

[51] Int. Cl.[5] ..... B41F 33/14

[52] U.S. Cl. ..... 101/212; 101/216; 100/53

[58] Field of Search ..... 101/216, 219; 100/53, 100/212; 192/129 R, 133, 134

[56] References Cited

U.S. PATENT DOCUMENTS

| | | | |
|---|---|---|---|
| 3,788,218 | 1/1974 | Fusco et al. | 101/216 |
| 4,295,421 | 10/1981 | Abendroth et al. | 101/216 |
| 4,454,812 | 6/1984 | Johne et al. | 101/216 |
| 4,669,380 | 6/1987 | Seib et al. | 101/216 |
| 4,699,260 | 10/1987 | Nieberding, Jr. | 192/134 |
| 4,905,596 | 3/1990 | Kobler | 101/216 |
| 5,241,903 | 9/1993 | Lampic | 100/53 |

FOREIGN PATENT DOCUMENTS

| | | |
|---|---|---|
| 1918173 | 8/1970 | Germany . |
| 2914152 | 10/1980 | Germany . |
| 8111567 | 12/1983 | Germany . |

*Primary Examiner*—Ren Yan

*Attorney, Agent, or Firm*—Herbert L. Lerner; Laurence A. Greenberg

[57] ABSTRACT

Device for safeguarding a hazardous location of a printing unit in a rotary printing press, wherein the hazardous location is at a cylinder region of the printing unit containing clamping elements, cylinder bearers and pressure-adjusting rods, includes multi-partite protective coverings having an areal or sheetlike form, respective swivel shafts vertically and horizontally disposed in the printing unit and carrying the protective coverings, respectively, the respective protective coverings being swivellable about the vertical and horizontal swivel shafts between an inwardly swung or closed position protective of the hazardous location, and an outwardly swung or open position affording access to the hazardous location for performing adjustment and maintenance operations thereat, a finger guard carried by the respective protective covering swivellable about the horizontal swivel shaft, and means for remotely controlling the swivelling of at least one of the protective coverings about the respective swivel shaft carrying the one protective covering.

8 Claims, 3 Drawing Sheets

DEVICE FOR SAFEGUARDING HAZARDOUS LOCATIONS OF A PRINTING UNIT

BACKGROUND OF THE INVENTION

Field of the Invention

The invention relates to a device for safeguarding hazardous locations of a printing unit on rotary printing presses, particularly with multi-partite protective coverings having an areal or sheetlike form.

A protective device on counter-rotating cylinders, particularly in printing presses, has become known heretofore from German Patent 19 18 173. A protective rod disposed parallel to axes of cylinders, which are changeable in the positions thereof relative to one another, automatically follows a swivelling movement of the cylinders and is swivellably mounted parallel to the counter-rotating cylinders and at a constantly like spaced distance therefrom. This heretofore known protective device, however, merely safeguards the printing nip between two printing-unit cylinders.

German Published Non-Prosecuted Patent Application (DE-OS) 29 14 152 discloses a safety device on sheet-fed rotary printing presses for safeguarding a roller nip, particularly between an impression cylinder and a blanket cylinder. Two metal plates or sheets carried on a hinge are in contact with a limit switch through the intermediary of a double-armed lever. The entire safety device of this German application, if required, can be exchanged for a complete washing device. Furthermore, the safety device can also be used for sheet guidance. A disadvantage, however, is that, with this heretofore known safety device, it is not possible to effect a complete safeguarding of all hazardous locations of a printing unit.

In German Published Patent Document 81 11 567 U1, a protective device on rotary printing presses is described wherein protective coverings, in an outwardly swung condition, are swivelled into engagement with one another, the individual protective coverings forming limit stops for protective coverings adjacent thereto. In this manner, good accessibility and very large operator zones on the printing unit are able to be achieved. A disadvantage of this heretofore known device, however, is that the protective coverings are manually operatable, so that the pressmen are able to open them before the printing press has come to a complete stop.

It is accordingly an object of the invention, starting from the aforedescribed state of the prior art, to provide a device for safeguarding hazardous locations on a printing unit independently of the pressman or other operating personnel.

SUMMARY OF THE INVENTION

With the foregoing and other objects in view, there is provided, in accordance with the invention, a device for safeguarding a hazardous location of a printing unit in a rotary printing press, wherein the hazardous location is at a cylinder region of the printing unit containing clamping elements, cylinder bearers and pressure-adjusting rods, comprising multi-partite protective coverings having an areal or sheetlike form, respective swivel shafts vertically and horizontally disposed in the printing unit and carrying the protective coverings, respectively, the respective protective coverings being swivellable about the vertical and horizontal swivel shafts between an inwardly swung or closed position protective of the hazardous location, and an outwardly swung or open position affording access to the hazardous location for performing adjustment and maintenance operations thereat, a finger guard carried by the respective protective covering swivellable about the horizontal swivel shaft, and means for remotely controlling the swivelling of at least one of the protective coverings about the respective swivel shaft carrying the one protective covering.

An advantage of the foregoing construction is that it provides a largely complete covering of all hazardous locations in the cylinder region of a printing unit, with which the printing-press personnel cannot tamper while the printing press is in operation. While the printing press is in operation, therefore, both the cylinder-bearer running surfaces, as well as the printing nip between the blanket cylinders, which is safeguarded by the finger guard, are protected against fouling and damage. Premature swinging away or opening of the protective coverings or guards, for example, as the printing press slowly decelerates or runs down before stopping, is not possible. The printing-press operating personnel can, consequently, be more carefully protected without thereby restricting the ease of operation of the printing press.

In accordance with another feature of the invention, the remotely controlling means comprise an actuating cylinder operatively connected to the one protective covering for swivelling the one protective covering.

In accordance with a further feature of the invention, means for enabling activation of the actuating cylinder are included for outwardly swinging or opening the one protective covering only when the printing press is stationary.

In accordance with an added feature of the invention, the one protective covering is the respective protective covering swivellable about the vertical swivel shaft and serves as a side protective guard swivellable outwardly by remote control to provide working access to the clamping elements of respective printing-unit cylinders. After the printing press has come to a standstill, i.e., is stationary, a safety button is pressed in order to swing outwardly or open the side protective coverings or guards for the cylinder region in the respective printing unit.

In accordance with an additional feature of the invention, respective actuating cylinders operatively connected to the protective coverings swivellable about both the horizontal and vertical swivel shafts, respectively, are provided for enabling access by remote control to printing-unit cylinders in the cylinder region of the printing unit. Both protective coverings swivel outwardly into the open positions thereof, thereby creating a freely accessible operator zone. The free access permits unobstructed working on the printing unit, for example, for changing a printing form or a cylinder dressing or packing on the printing-unit cylinders.

In an advantageous embodiment, the finger protective guard has a basically triangular cross section. Consequently, the finger protective guard is able to enter as deeply as possible into a printing nip between two of the printing-unit cylinders.

In accordance with yet another feature of the invention, a locking pin is disposed on the finger guard.

In accordance with a concomitant feature of the invention, the printing press has a side wall formed with a bore at a location thereof to which the respective protective covering is outwardly swingable about the horizontal swivel shaft, the locking pin being receivable in the bore for locking the respective protective covering in the outwardly swung location thereof.

Other features which are considered as characteristic for the invention are set forth in the appended claims.

Although the invention is illustrated and described herein as embodied in a device for safeguarding hazardous locations of a printing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
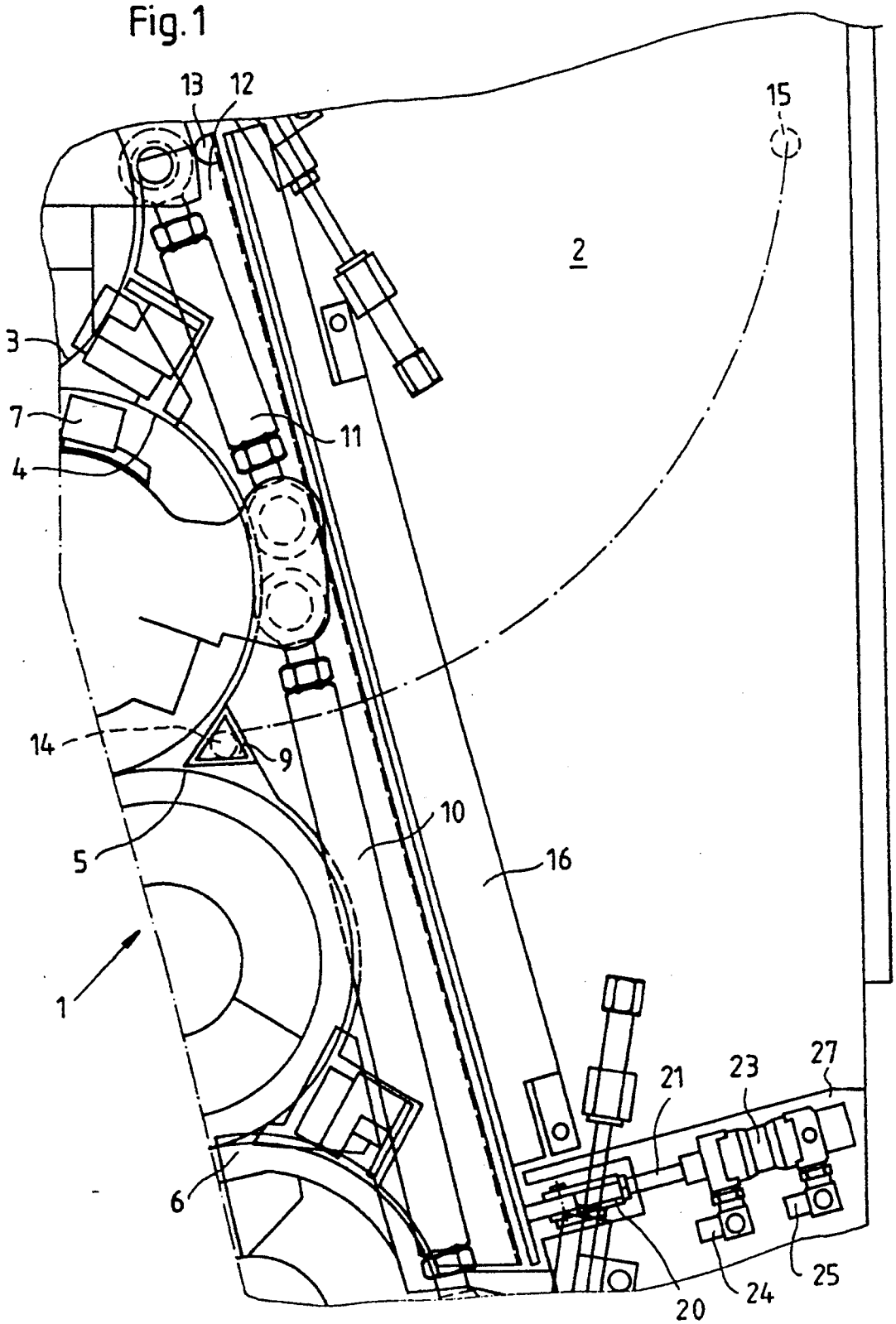
FIG. 1 is a fragmentary side elevational view of a printing unit with protective guards according to the device of the invention shown in operative position.

Referring now to the drawings and, first, particularly to FIG. 1 thereof, there are shown therein a plate cylinder 3 and a blanket cylinder 4 journalled in opposite side walls 2 of a printing unit 1 above a web of material to be printed. Journalled below the web of material are another plate cylinder 6 and another blanket cylinder 5. A web of material passes through the printing unit 1 between the upper blanket cylinder 4 and the lower blanket cylinder 5. Also attached to the printing-unit cylinders 3, 4, 5 and 6 are clamping elements 7, inter alia, which are manipulated by the pressmen when the printing press is stationary and which, therefore, must be readily accessible.

In addition, the printing-unit cylinders 3, 4, 5 and 6 are provided, at the end faces thereof, with Schmitz rings or cylinder bearers 8 having specially treated surfaces running on one another. The printing-unit cylinders 3, 4, 5 and 6 are braced against one another by pressure-adjusting rods 10 and 11. The pressure-adjusting rods 10 and 11, the cylinder bearers 8 and the clamping elements 7 are covered by a longitudinal protective guard 12, upwardly swingable about a swivel shaft 13, and by at least one remotely controlled, pneumatically swivellable side protective guard 16.

A finger guard 9 is attached to the upwardly swingable longitudinal protective guard 12 in a region thereof which dips, during the swing or swivelling movement, into the printing nip between the blanket cylinders 4 and 5. The finger guard 9 has a basically triangular cross section and is in the form of a hollow profile wherein a locking pin 14 is displaceably held. When the longitudinal protective guard 12 is swivelled upwardly about the swivel shaft 13, which is electrically safeguarded, the locking pin 14 is merely inserted into a bore 15 formed in the side wall 2 in order to lock the longitudinal protective guard 12 in the upwardly swung or open position thereof. In addition to manual operability of the longitudinal protective guard 12, the upward swing of the protective guard on the web outlet side of the printing unit 1 may also be assisted by a gas-pressure cylinder and may be held in position by the latter, a pneumatic, remotely controlled actuation of the longitudinal protective guard 12 being also conceivable, as well, after the opening of the side protective guard 16.

It is apparent that the side protective guard 16 is connected to a fork 20, in the lower part of FIG. 1. The fork 20, in turn, is actuatable by an actuating cylinder 23 through the intermediary of a piston rod 21. The actuating cylinder 23 has two unions 24 and 25 for a pressure medium, such as compressed air. The actuating cylinder 23, the unions 24 and 25, as well as the piston rod 21 and the fork 20, are protected by a covering 27 against fouling; moreover, the cover 27 prevents injuries to the printing-press operators.

Figure 2:
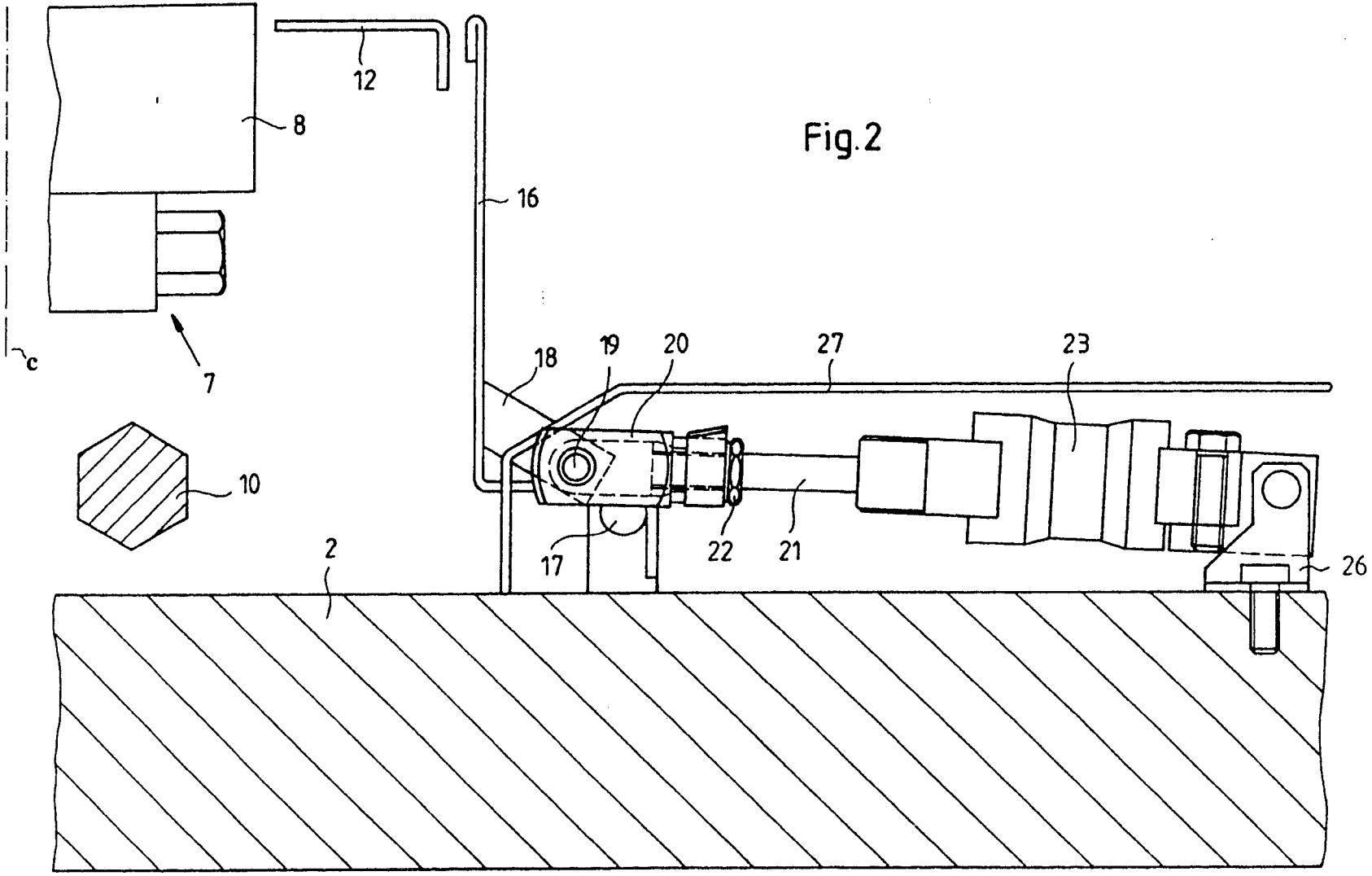
FIG. 2 is an enlarged, fragmentary top plan view, partly in section, of FIG. 1, showing an actuating cylinder mounted on a side wall with a side protective guard in operative position.

As shown in the top plan view of FIG. 2, the covering 27 covers the actuating cylinder 23, which is movably mounted in a counter-bearing 26 on the side wall 2. The piston rod 21, which is extensible out of the actuating cylinder 23, is provided with a threaded section whereon an adjusting nut 22 is threadedly turnable for changing the position of the fork 20. A fine adjustment of the swivel or swing distance of the side protective guard 16 can thereby be effected. In the condition or phase of operation shown in FIG. 2, the piston rod 21 has been extended out of the actuating cylinder 23 and has swivelled an angularly bent end of a strap of the side protective guard 16 about a vertical swivel shaft 17. A pin 19 disposed in the fork 20 serves as a bearing for a connecting piece 18 to which the side protective guard 16 is attached. Due to the turning of the connecting piece 18 about the pin 19, the side protective guards 16 swivel into the closed position thereof, at an angle of approximately 90 degrees to the covering 27. Consequently, the free space and, there-with, the accessibility of the clamping elements 7 and of the pressure-adjusting rod 10 from outside are restricted. FIG. 2 further shows the longitudinal protective guard 12 between the side protective guard 16 and the surface of the cylinder bearer 8. In the illustrated position, the longitudinal protective guard 12 completes the covering of the surfaces of the cylinder bearers 8 and of the clamping elements 7 on a printing-unit cylinder. The vertically extending center line c adjacent the part of the cylinder bearer 8 and the indicated clamping element 7 shown in FIG. 2 represents the rotational axis of the respective printing-unit cylinder.

Figure 3:
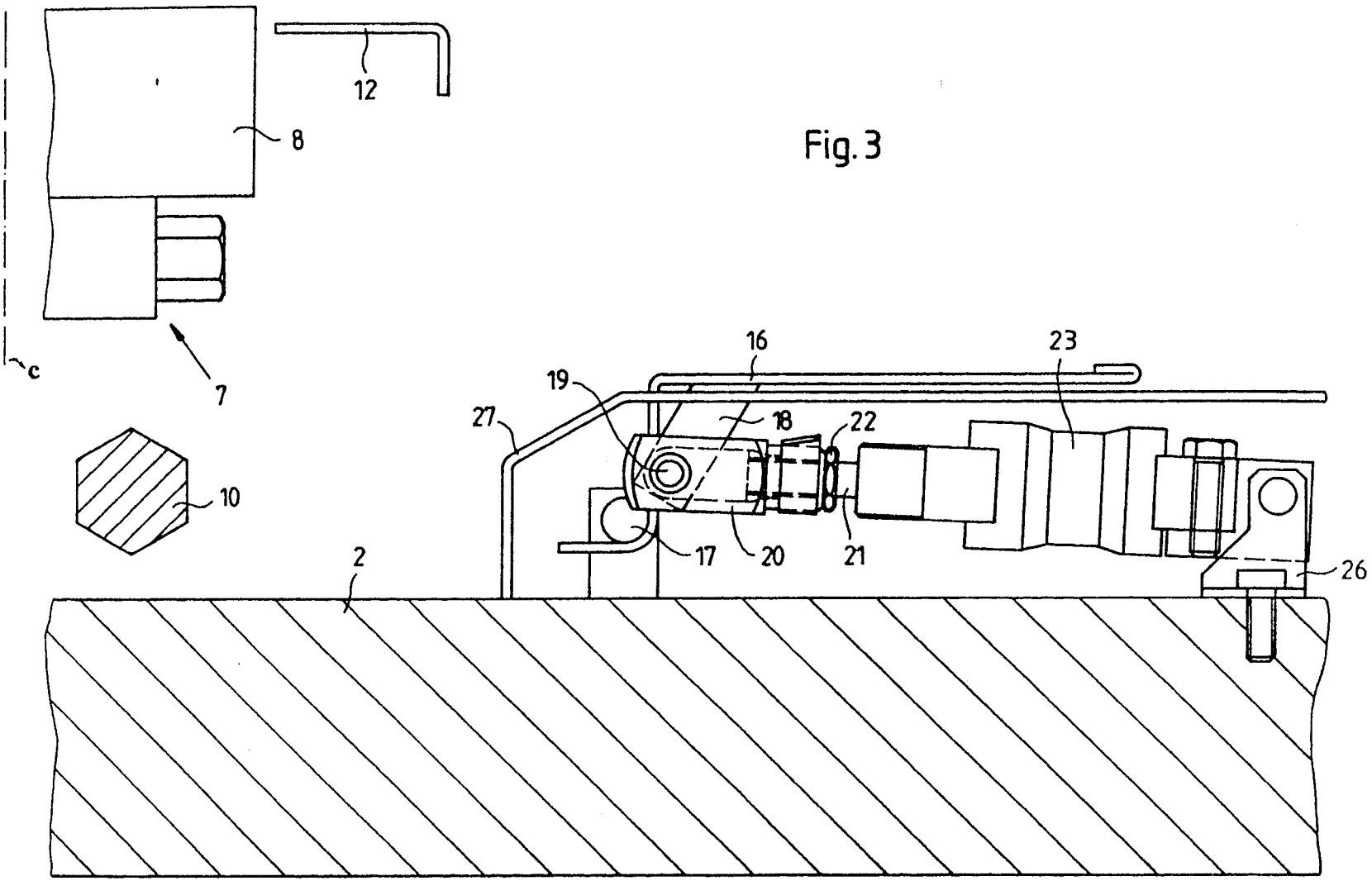
FIG. 3 is a view like that of FIG. 2 showing the side protective guard in a swung-away position so that clamping elements on the printing-unit cylinder are accessible.

As shown in FIG. 3, the side protective guard 16 is in a swung-away or downwardly-swung position thereof wherein it lies parallel to the covering 27 which is attached to the side wall 2. The pressman thus has access to the clamping element 7 in order to be able to perform adjustments. In the operating phase or condition shown in FIG. 3, the upwardly swingable longitudinal protective guard 12 has remained in its position covering the hazardous location of the printing unit 1.

The manner in which the longitudinal protective guard 12 and the side protective guards 16 operate is explained hereinafter in greater detail: With the printing press stationary, the pressman actuates the "Safety" function at the printing-press control console. The actuating cylinders 23 in the respective printing units 1 are energized and swivel the side protective guards 16 into the positions thereof shown in FIG. 3, namely parallel to the covers 27 and the side wall 2. Accordingly, the clamping elements 7 of the respective printing-unit cylinders are freely accessible. After having performed all the operations on the printing units 1, the pressman actuates the "Safety off" function on the printing-press control console, and the side protective guards 16 swivel again into the closed position thereof.

In order to permit work to be performed on the printing-unit cylinders without any impairment of accessibility, it is possible, to swing the longitudinal protective guard 12 upwardly manually, when the printing press is stationary. The finger guard 9 attached to the longitudinal protective guard 12 is likewise swung downwardly when the longitudinal protective guard 12 is operated. The printing nip between the blanket cylinders 4 and 5 is accordingly safeguarded during operation by the finger guard 9 whereas, when the longitudinal protective guard 12 is swung downwardly, the finger guard 9 is swivelled out of the printing nip between the blanket cylinders 4 and 5, thereby permitting unimpeded working. With the longitudinal protective guard 12 in the upwardly swung position into which it has swivelled about the electrically safeguarded swivel shaft 13, a start-up of the printing press is blocked or disabled. Locking of the longitudinal protective guard 12 in the upwardly swung position thereof is accomplished by introducing the locking pin 14 into the bore 15 formed in the side wall 2.

We claim:

1. In a rotary printing press, a printing unit including adjacent printing cylinders forming a nip therebetween, and a side section having clamping elements, cylinder bearers and cylinder pressure-adjusting rods disposed therein, a safety device mounted in the vicinity of the printing unit for safeguarding against injuries to the press operators comprising:

a first protective covering;

a horizontal shaft disposed in the printing unit carrying said first protective covering;

said first protective covering being swivellable about said horizontal shaft between an outwardly open position in which the cylinder nip is accessible to the press operators and an inwardly closed position in which said first protective covering covers the nip;

a second protective covering;

a vertical shaft disposed in the printing unit carrying said second protective covering;

said second protective covering being swivellable about said vertical shaft between an open position in which the side section of the printing unit is accessible for performing adjustment and maintenance operations by the operators and a closed position in which said second protective covering covers said side section of the printing unit;

a finger guard carried by said first protective covering; and means for remotely controlling the swivel motion of at least one of said first and second protective coverings about the corresponding shaft carrying said at least one protective covering.

2. The safety device as defined in claim 1, wherein said remotely controlling means comprises an actuating cylinder operatively connected to said at least one protective covering for swivelling said at least one protective covering.

3. The safety device as defined in claim 2, further including means for enabling activation of said actuating cylinder for swinging said at least one protective covering to the open position only when the printing press is not operating.

4. The safety device as defined in claim 3, wherein said at least one protective covering is said second protective covering swivellable about said vertical shaft.

5. The safety device as defined by claim 3, further including a second actuating cylinder operatively connected to the other of said first and second protective coverings and controlled by said remotely controlling means.

6. The safety device as defined by claim 2, wherein said finger guard has a basically triangular cross section so as to be able to enter deeply into said nip.

7. The safety device as defined by claim 2, further including a locking pin disposed on said finger guard.

8. The safety device as defined by claim 7, wherein the printing press having a side wall, a bore formed at a location on said side wall to which said first protective covering is outwardly swingable about said horizontal shaft, and said locking pin being receivable in said bore for locking said first protective covering in said outwardly swung location thereof.

* * * * *